US007874017B2

(12) United States Patent
Jones

(10) Patent No.: US 7,874,017 B2
(45) Date of Patent: Jan. 25, 2011

(54) FLEXIBLE KNEE PAD WITH ROTATING KNEE SUPPORT CUSHION

(76) Inventor: Grant B. Jones, 2920 Capazo Ct., Carlsbad, CA (US) 92009

( * ) Notice: Subject to any disclaimer, the term of this patent is extended or adjusted under 35 U.S.C. 154(b) by 91 days.

(21) Appl. No.: 12/004,982

(22) Filed: Dec. 26, 2007

(65) Prior Publication Data

US 2008/0289073 A1 Nov. 27, 2008

Related U.S. Application Data

(60) Provisional application No. 60/939,990, filed on May 24, 2007.

(51) Int. Cl.
*A41D 13/00* (2006.01)

(52) U.S. Cl. ..... 2/24

(58) Field of Classification Search ..... 2/23, 2/24, 16, 62, 242, 455, 911; 128/881, 882; 602/16, 25, 26, 62
See application file for complete search history.

(56) References Cited

U.S. PATENT DOCUMENTS 573,919 A * 12/1896 Rice ..... 2/24
1,087,863 A * 2/1914 Andrews ..... 2/24
1,131,816 A * 3/1915 Bassett ..... 2/24
1,185,758 A * 6/1916 Ashton ..... 2/24
1,271,119 A * 7/1918 BGarrett ..... 2/24
1,293,240 A * 2/1919 Summers ..... 2/24
1,761,093 A * 6/1930 Shotwell ..... 2/24
4,642,814 A * 2/1987 Godfrey ..... 2/462
6,795,974 B1 9/2004 Howell
6,913,583 B2 * 7/2005 Jestrabek-Hart ..... 602/16

* cited by examiner

*Primary Examiner*—Tejash Patel
(74) *Attorney, Agent, or Firm*—Morland C. Fischer

(57) ABSTRACT

A flexible knee pad of the kind to be worn over the knee of a workman who must kneel down for long periods of time while working on a work surface. According to a preferred embodiment, the flexible knee pad includes an upper knee support cushion against which the workman's knee is laid, a lower pivot support base to rest upon the work surface, and an intermediate pivoting reinforcement plate having a flat bed upon which the knee support cushion is seated. The intermediate pivoting reinforcement plate includes a pair of pivots that are coupled to respective pivot slots formed in the lower pivot support base. Accordingly, the pivoting reinforcement plate, the knee support cushion seated thereon, and the workman's knee are all suspended by and rotatable relative to the pivot support base above the work surface so as to advantageously reduce pressure applied to the workman's knee cap by the work surface should he rock his body and shift his weight back and forth over the work surface.

15 Claims, 7 Drawing Sheets

FLEXIBLE KNEE PAD WITH ROTATING KNEE SUPPORT CUSHION

CROSS REFERENCE TO RELATED APPLICATIONS

This patent application is related to Provisional Application No. 60/939,990 filed May 24, 2007.

BACKGROUND OF THE INVENTION

1. Field of the Invention

This invention relates to an improved flexible knee pad of the kind to be worn to protect the knee of a workman who must kneel down for long periods of time while working on a work surface. The knee pad of this invention includes a knee pad cushion which is adapted to rotate and deflect pressure away from the workman's knee cap in response to the force generated by the knee as the workman shifts his weight and rocks back and forth.

2. Background Art

Workers who lay tile, install a floor, smooth a poured cement surface, etc. are frequently forced to kneel down on the work surface for long periods of time. To minimize the discomfort of kneeling on a hard work surface, the workman usually covers his knees with padded knee pads. However, the conventional knee pads do little more than keep the workman's knees from impacting the work surface. Consequently, the workman's knees are still subjected to discomfort and possible injury, particularly when the workman must kneel down for a long period of time during the work day.

What is more, from time to time, the workman will shift his weight and rock back and forth to reach different locations on the work surface. However, the conventional knee pad remains stationary as the workman leans forwards and back. That is to say, there is no provision in the conventional knee pad to deflect pressure applied from the work surface away from the knee as the workman moves his body from a generally vertical erect position towards a generally horizontal position while kneeling down during the job. In this case, the majority of the pressure generated by the hard work surface is transmitted through the conventional knee pad and directly against the workman's knee which has been known to result in pain and/or knee damage over time.

Therefore, what is desirable is an improved knee pad to be worn over the knee while a workman is kneeling down on a work surface that is capable of suspending the knee above the work surface while absorbing and deflecting pressure away from the knee cap to reduce discomfort and minimize the risk of knee damage.

SUMMARY OF THE INVENTION

In general terms, an improved, flexible knee pad is disclosed to be worn over the knee of a workman who is kneeling down on a work surface. The improved knee pad is adapted to absorb and deflect pressure away from the workman's knee to improve comfort and reduce the possibility of knee damage when the workman must kneel down during a long work day. According to a first preferred embodiment, the knee pad includes an outer shell having a longitudinal depression in which to receive the knee and a portion of the leg of the workman. The flexible shell surrounds an upper knee support cushion, a lower pivot support base, and an intermediate pivoting reinforcement plate. The upper knee support cushion lies below the longitudinal depression in the outer shell and is preferably manufactured from a soft, cushion material. The intermediate pivoting reinforcement plate includes a pair of pivots which project outwardly therefrom and a flat bed upon which the upper knee support cushion is seated. The lower pivot support base includes a curved bottom to rest upon the work surface, a pair of upstanding side walls, and a pair of pivot slots formed in the sidewalls to receive respective ones of the pivots which project from the intermediate pivoting reinforcement plate. The knee support cushion and pivoting reinforcement plate are attached to one another and adapted to rotate together relative to the lower pivot support base. The upper knee support cushion and the intermediate pivoting support plate have air holes extending vertically therethrough which communicate to establish a ventilation system to permit the improved flexible knee pad to breathe while in use.

Should the workman shift his weight and move his body from a generally vertical, erect position to a generally horizontal position, a force generated by the workman's knee against the flexible outer shell of the knee pad is transmitted to the front of the upper knee support cushion. The combined upper knee support cushion and intermediate pivoting reinforcement plate, which are suspended above the work surface by the lower pivot support base, will rotate at the pivots which project from the intermediate pivoting reinforcement plate. By virtue of the foregoing, the pressure normally applied to the workman's knee by the work surface will be absorbed by the upper knee support cushion and deflected away from the knee cap by the rotating combined knee support cushion and pivot support base.

According to an alternate, two-piece knee pad embodiment, the intermediate pivoting reinforcement plate and the lower pivot support base are now replaced by a single resilient lower support and reinforcement base. The previously-described upper knee support cushion is attached to the lower support and reinforcement base within an outer shell. The resilient lower base has a flat bed upon which the knee support cushion is seated, a bottom lying opposite the flat bed to rest upon the work surface, and an evacuated area extending between the flat bed and bottom. Should the workman shift his weight and lean forward from the erect, vertical position towards the horizontal position, the force generated by the user's knee against the outer shell is transferred through the upper knee support cushion to the resilient lower base. Such force causes the lower base to function as a compression spring such that the flat bed thereof moves downwardly through the evacuated area towards the bottom. By virtue of the foregoing, the pressure applied to the workman's knee cap by the work surface will be absorbed by the upper knee support cushion and the spring-like action of the resilient lower support and reinforcement base.

DESCRIPTION OF THE PREFERRED EMBODIMENT

Figure 2:
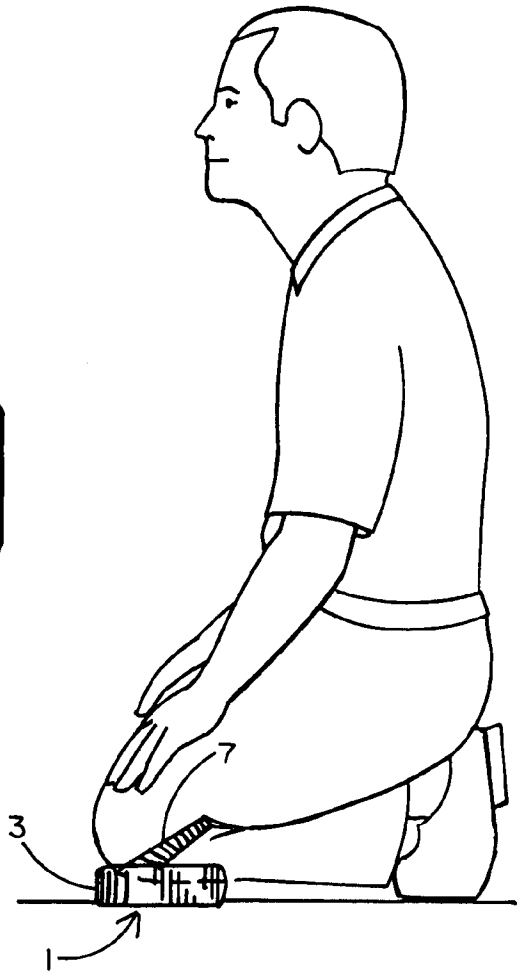
FIG. 2 shows the workman wearing the knee pads of FIG. 1 and kneeling in a generally erect, vertical position on the work surface.
Figure 1:
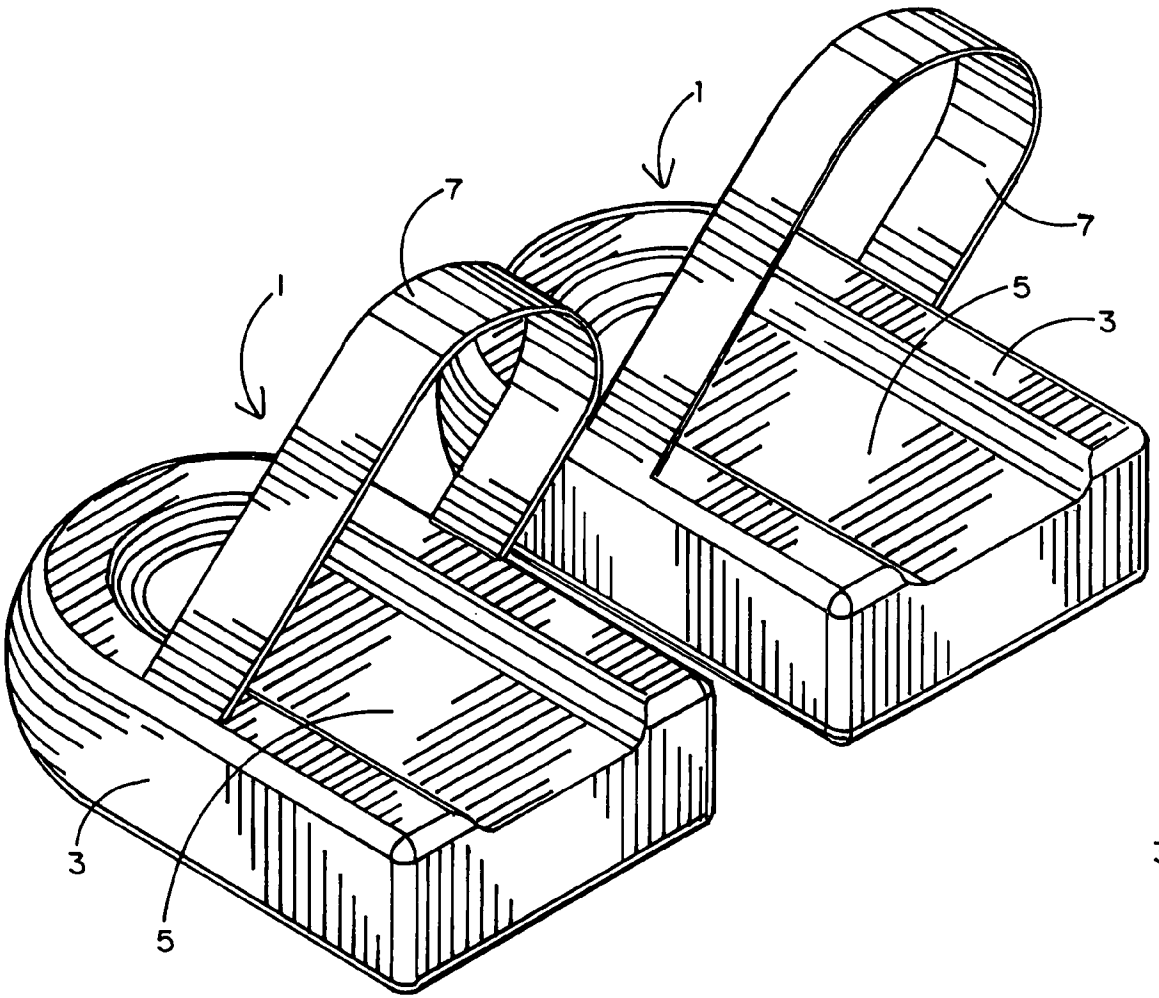
FIG. 1 shows a pair of flexible knee pads according to a first preferred embodiment of the present invention to be strapped to and cover the knees of a workman kneeling down on a work surface.
Figure 3:
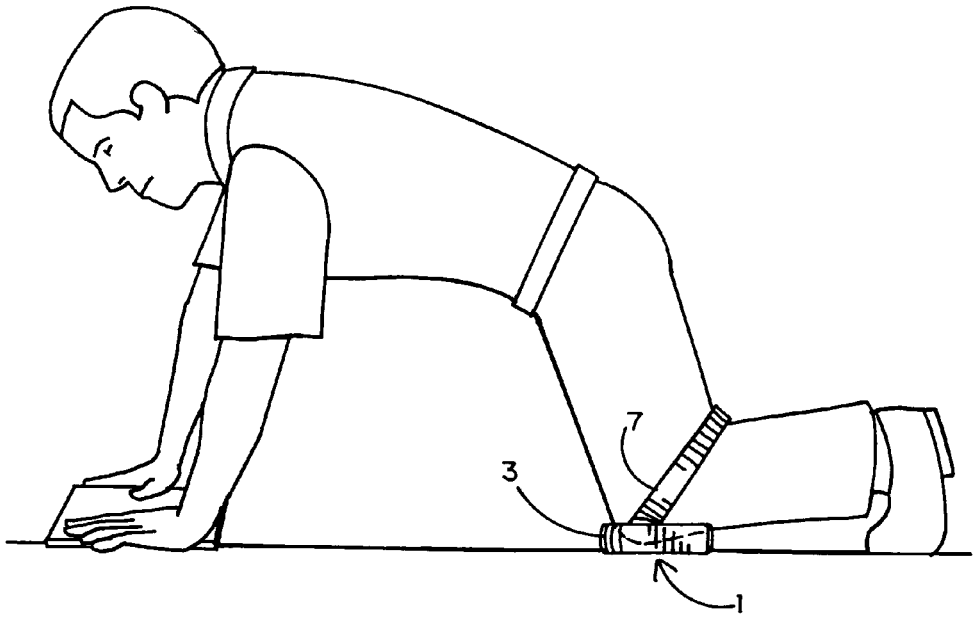
FIG. 3 shows the workman wearing the knee pads and shifting his body and his weight from the vertical, erect position of FIG. 2 to a generally horizontal position.

Referring initially to FIGS. 1-3 of the drawings, there is shown a pair of flexible knee pads 1 of the type to be worn by a workman (best shown in FIGS. 2 and 3) to prevent discomfort or injury to his knees while having to kneel down and rock back and forth while working for long periods of time on a floor, pavement or similar work surface. The pair of knee pads 1 are identical and, therefore, only a single knee pad will be described in detail herewithin.

As is best shown in FIG. 1, each knee pad 1 includes an outer covering or shell 3 that is preferably manufactured from a soft air-permeable material. A longitudinally-extending depression 5 is formed (e.g., molded) in the outer shell 3 of each knee pad 1. An elastic leg strap 7 is connected between opposite sides of the outer shell 3 so that the knee pad can be held against the knee of the workman in the manner shown in FIGS. 2 and 3. That is, the elastic straps 7 of respective knee pads 1 surround the legs of the workman, such that the depressions 5 formed in the outer shells 3 are positioned for receipt of the workman's knees and some of his legs. By virtue of the foregoing, the pair of knee pads 1 will lie between the work surface and his knees when the workman kneels down, rocks back and forth, and slides along the work surface.

Figure 5:
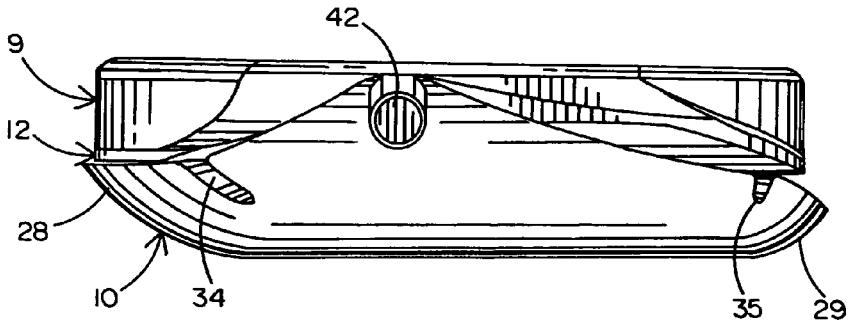
FIG. 5 is a side view of the knee pad components of FIG. 4 in their assembled configuration.
Figure 4:
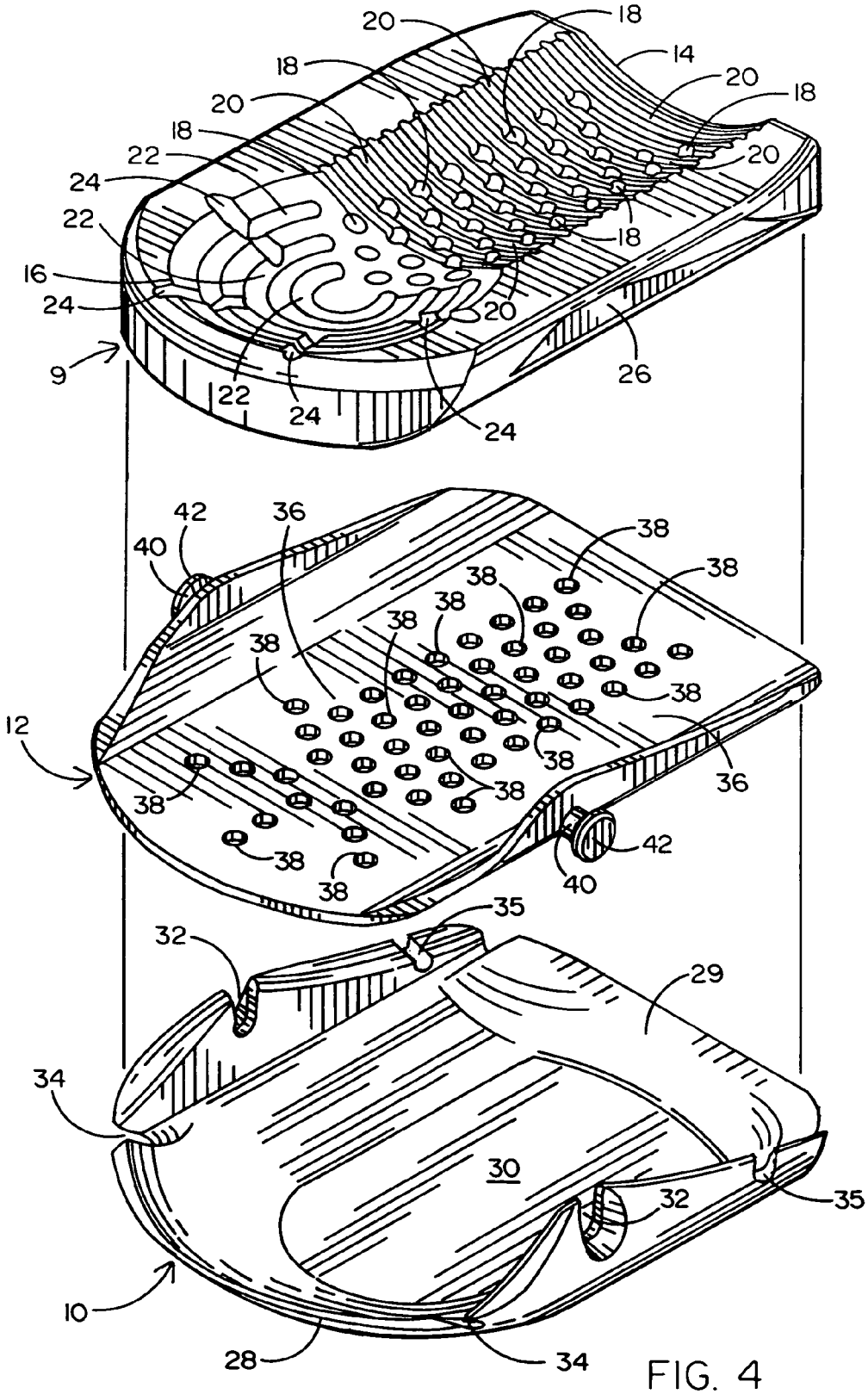
FIG. 4 is an exploded view of the components which form the flexible knee pad.
Figure 6:
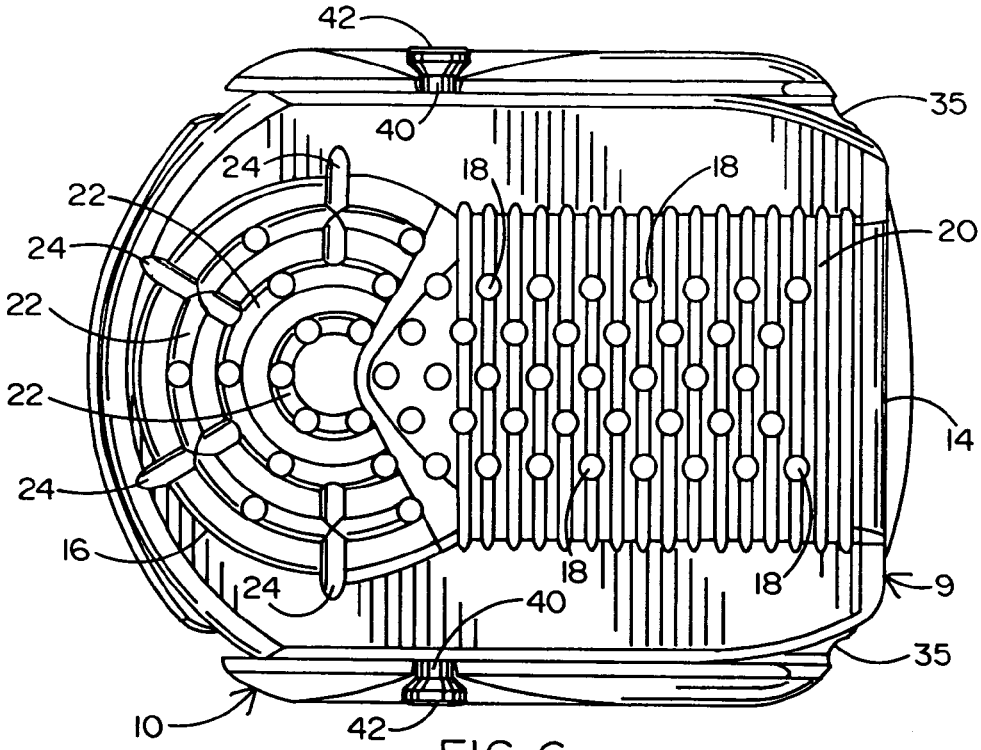
FIG. 6 is a top view of the assembled knee pad components shown in FIG. 5.
Figure 7:
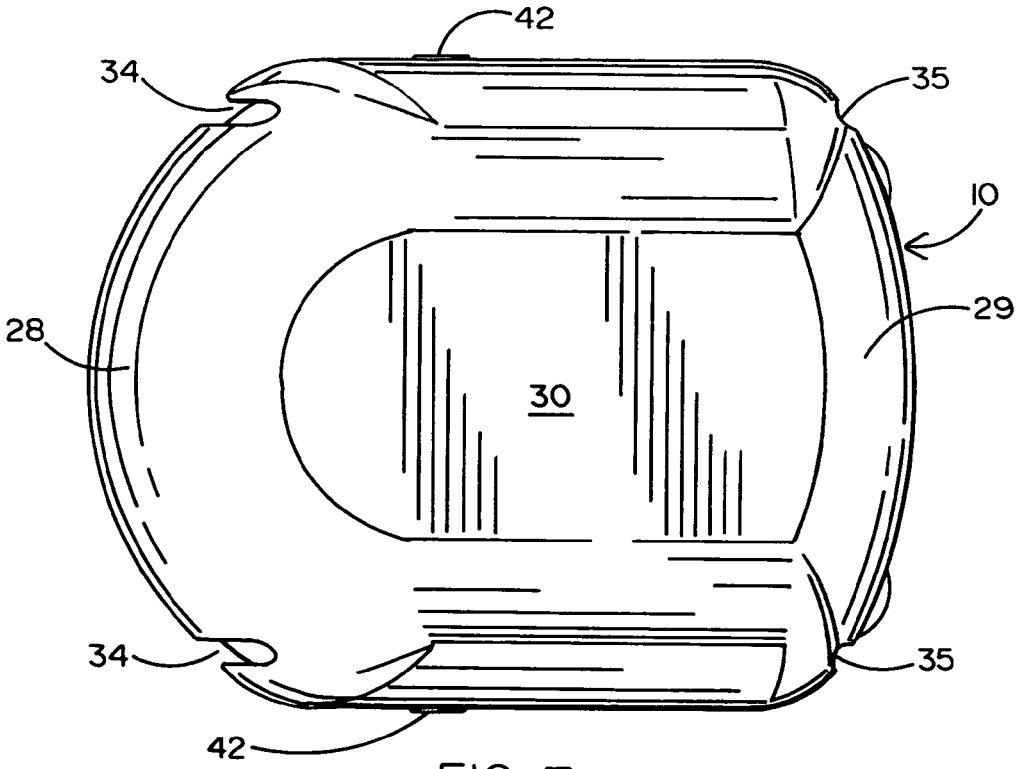
FIG. 7 is a bottom view of the assembled knee pad components shown in FIGS. 5 and 6.

FIG. 4 of the drawings is an exploded view illustrating the interior of one of the flexible knee pads 1 of FIG. 1 with the outer shell 3 thereof removed. In this regard, it is to be understood that the outer shell 3 of FIG. 1 may be eliminated altogether from the knee pad 1. The interior of the knee pad 1 includes an upper knee support cushion 9, a lower pivot support base 10, and an intermediate pivoting reinforcement plate 12 located between the upper cushion 9 and the lower base 10. As will soon be described and is best shown in the assembled relationship of FIGS. 5-7, the upper knee support cushion 9 is seated upon and attached to the intermediate pivoting reinforcement plate 12, and the reinforcement plate 12 is carried by and adapted to rotate relative to the lower pivot support base 10 as the workman rocks back and forth while resting on his knees and shifting his weight on the work surface. In this way, the workman's knees will be suspended above the work surface and comfortably cushioned so as to reduce the pressure and the impact forces to which his knees caps would otherwise be subjected during the job.

The upper knee support cushion 9 of the flexible knee pad which is surrounded by the outer shell 3 of FIG. 1 functions as a pillow above which the workman's knee is positioned when the knee pad is held against the workman's knee and leg as shown in FIGS. 2 and 3. Thus, the knee support cushion 9 is contoured to conform with the size and shape of the workman's leg and knee. The shape of support cushion 9 also corresponds with the longitudinal depression (designated 5 in FIG. 1) formed in the outer shell 3 of knee pad 1 which surrounds support cushion 9. In particular, the knee support cushion 9 includes a longitudinal trough 14 at the rear thereof which communicates with a dish-shaped recess 16 at the front. When the workman kneels upon the outer shell 3 of flexible knee pad 1, his knee will press against the dish-shaped recess 16, and his leg will press against the longitudinal trough 14. The knee support cushion 9 is preferably manufactured from a relatively soft (e.g., foam or gel) material, or the like, which is capable of being compressed in order to cushion the workman's knee.

A plurality of through holes 18 run vertically and completely through the longitudinal trough 14 at the rear of knee support cushion 9. A set of arcuate grooves 20 is formed in the trough 14 to provide air flow paths to the through holes 18. The grooves 20 and through holes 18 cooperate to establish a ventilation system through the knee support cushion 9 when the workman kneels down and rests his knee and leg within the depression 5 of the outer shell 3 of knee pad 1.

A plurality of (e.g., three) concentric channels 22 extend vertically through the dish-shaped recess 16 at the front of the knee support cushion 9. A set of radial cavities 24 cut across and link the two outermost concentric channels 22. The channels 22 and the cavities 24 which communicate therewith cooperate to establish the aforementioned ventilation system through the knee support cushion 9.

An evacuated area 26 runs laterally through the upper knee support cushion 9. The evacuated area 26 facilitates the compression of the knee support cushion 9 in response to the force generated against the longitudinal trough 14 and the dish-shaped recess 16 when the workman's knee and leg are pressed against the depression 5 of the outer shell 3 of the flexible knee pad 1 of FIG. 1.

The lower pivot support base 10 which is surrounded by the outer shell 3 of flexible knee pad 1 is preferably manufactured from a wear-resistant (e.g., Neoprene) material. The opposing front and rear ends of pivot support base 10 are curved to rotate over the work surface should the workman rock back and forth against the work surface with the knee pad 1 strapped to his knee. The bottom 30 of pivot support base 10 is flat to create a stable surface to permit the intermediate pivoting reinforcement plate 12 to rotate relative to the pivot support base 10 in a manner that will soon be disclosed. To this end, a pivot slot 32 is formed in each upstanding side wall of the pivot support base 10 at which the pivoting reinforcement plate 12 is coupled to facilitate the rotation thereof. Pairs of flex gaps 34 and 35 are located at the front and rear ends 28 and 29 of pivot support base 10 to absorb stresses to which the pivot support base 10 will be subjected during the rotation of reinforcement plate 12.

The intermediate pivoting reinforcement plate 12 which is surrounded by the outer shell 3 of the flexible knee pad 1 of FIG. 1 is preferably manufactured from a stiff but flexible material. Reinforcement plate 12 has a flat bottom 36 to create a bed for receiving and supporting thereagainst the relatively soft and compressible upper knee support cushion 9. In this regard, the upper knee support cushion 9 and the intermediate pivoting reinforcement plate 12 are attached to one another, such as by means of an adhesive bond therebetween. Thus, the upper knee support cushion 9 and the intermediate pivoting reinforcement plate 12 are joined together and adapted to rotate as a unit relative to the lower pivot support base 10.

pivot support base 10 should the workman rock back and forth and shift his weight while kneeling on the work surface with the flexible knee pads 1 of FIG. 1 strapped to his knees.

Figure 8:
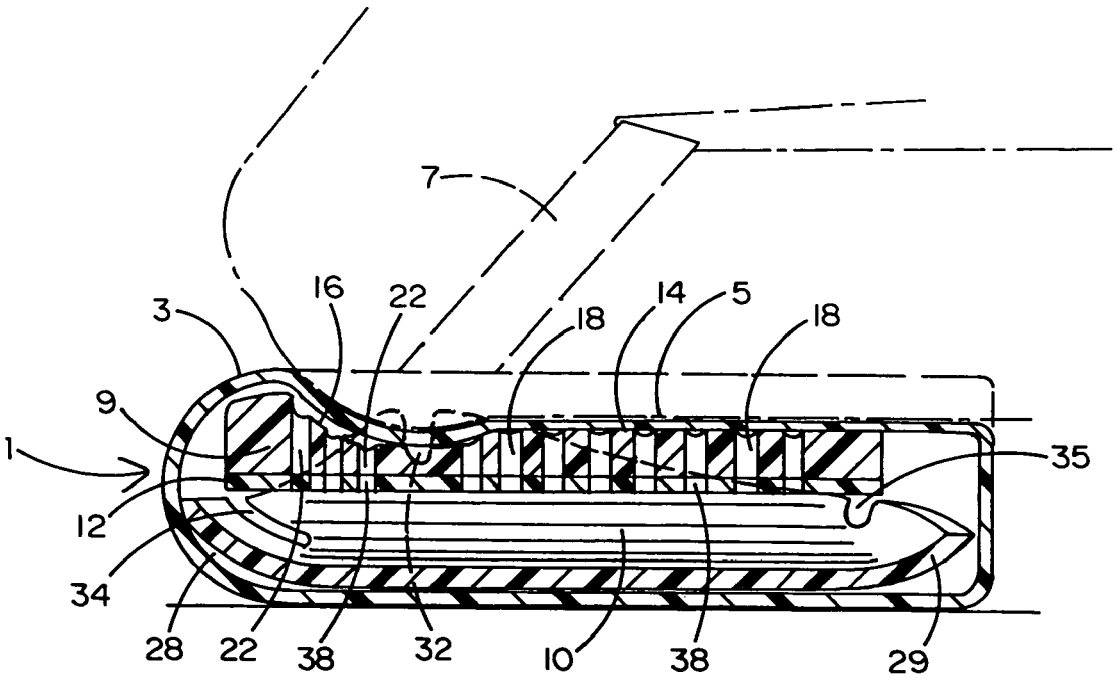
FIG. 8 is a cross section of the knee pad of FIG. 4 when the body of the workman is in the generally vertical, erect position of FIG. 2.
Figure 9:
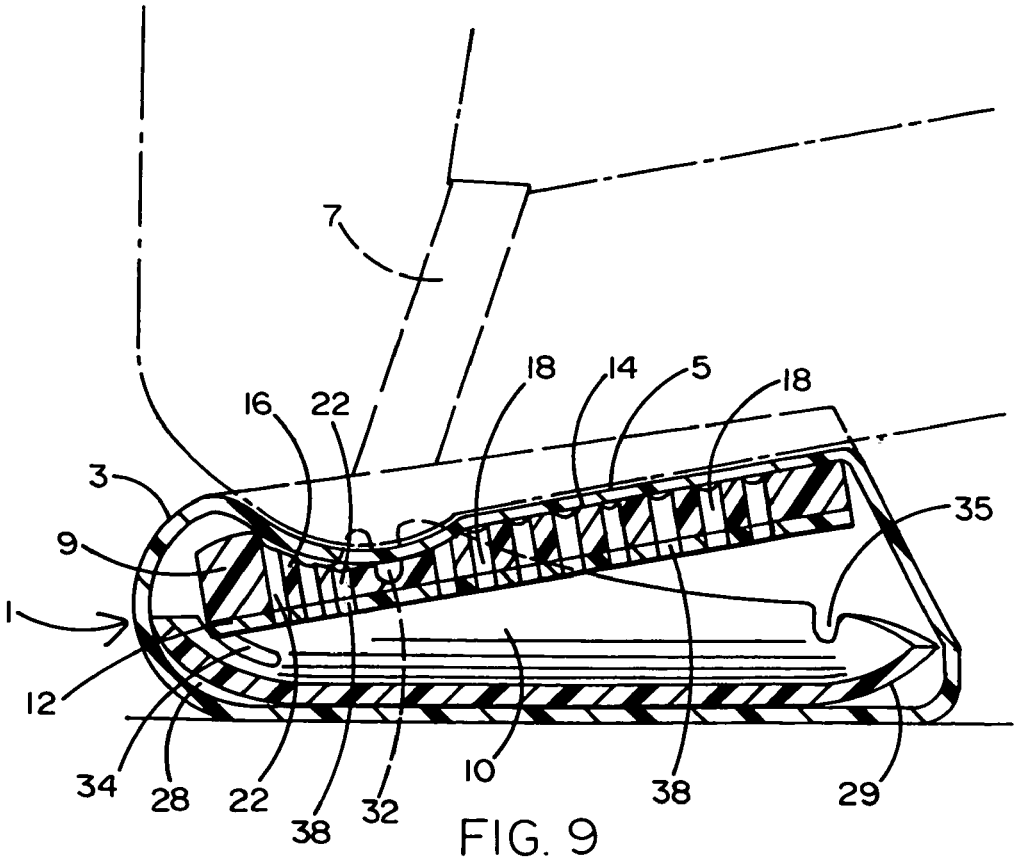
FIG. 9 is a cross section of the knee pad of FIG. 4 when the body of the workman leans forward to the generally horizontal position of FIG. 3.

Turning in this regard to FIGS. 8 and 9 of the drawings, FIG. 8 shows the knee and a portion of the leg of the workman seated within and lying flush against the longitudinal depression 5 in the outer shell 3 of the flexible knee pad 1 when the workman's body is held in an erect, vertical position as illustrated at FIG. 2. FIG. 8 shows the workman leaning forward as his body shifts from the erect position of FIG. 2 towards a generally horizontal position of FIG. 3. In each case, the workman's knee cap extends forward of the pivots 40.

With the workman's body in the erect, vertical position of FIG. 2, the force applied by the knee and leg of the workman against the longitudinal depression 5 of outer shell 3 is evenly distributed along the longitudinal trough 14 and the dish-shaped recess 16 of the upper knee support cushion 9 which are positioned below the outer shell 3. In this case, the combination upper knee support cushion 9 and intermediate pivoting reinforcement plate 12 of knee pad 1 is disposed in parallel alignment with respect to the bottom 30 of the lower pivot support base 10.

However, when the workman's body (as well as his weight) shifts from the vertical erect position towards the horizontal position of FIG. 3, the force applied by the knee and leg against the longitudinal depression 5 of outer shell 3 is now directed primarily against the front of the flexible knee pad. Such force is transmitted through the outer shell 3 to the dish-shaped recess 16 at the front of the upper knee support cushion 9. In this case, the combination upper knee An array of air holes 38 extend vertically through the flat bottom 36 of the intermediate pivoting reinforcement plate 12. In the assembled relationship best shown in FIG. 6, some of the air holes 38 of pivoting reinforcement plate 12 are axially aligned with respective vertical through holes 18 formed through the longitudinal trough 14 at the rear of upper knee support cushion 9. Other ones of the air holes 38 at the front of the pivoting reinforcement plate 12 are arranged in rows that communicate with the concentric channels 22 through the dish-shaped recess 16 at the front of knee support cushion 9. The continuous air flow paths created by the cooperation of air holes 38 with the through holes 18 and the concentric channels 22 complete the ventilation system through the upper knee support cushion 9 and intermediate pivoting reinforcement plate 12 to enable the flexible knee pad 1 to breathe while in use by way of the permeable outer shell 3 of FIG. 1.

A pair of pivots 40 project outwardly and in opposite directions from opposing side walls which stand upwardly from the bed 36 of the pivoting reinforcement plate 12. Each pivot 40 terminates at a relatively large head 42. In the assembled configuration of FIGS. 5-7, the pair of pivots 40 of the intermediate pivoting reinforcement plate 12 are received in respective ones of the pivot slots 32 formed in opposing side walls of the lower pivot support base 10. Thus, it may be appreciated that the combination of the upper knee support cushion 9 and intermediate pivoting reinforcement plate 12 are pivotally coupled to and suspended by the lower pivot support base 10 above the flat bottom 30 thereof when the pivots 40 are received by pivot slots 32. As will now be described while referring to FIGS. 8 and 9, the combination knee support cushion 9 and pivoting reinforcement plate 12 are adapted to rotate at pivots 40 relative to the support cushion 9 and intermediate pivoting reinforcement plate 12 will rotate with respect to the bottom 30 of the lower pivot support base 10.

More particularly, the workman's forward leaning knee shown in FIG. 9 generates a force that is applied to the recess 16 at the front of knee support cushion 9 to cause the support cushion 9 and pivoting reinforcement plate 12 on which the support cushion 9 is seated to rotate in a counterclockwise direction above the bottom of pivot support base 10. That is, by virtue of the receipt of the pivots 40 of pivot reinforcement plate 12 within the pivot slots 32 of pivot support base 10 (best shown in FIG. 5), the knee support cushion 9 and pivoting reinforcement plate 12, which are suspended above the work surface by the pivot support base 10, are adapted to rotate back and forth towards and away from the bottom 30 of pivot support base 10 depending upon whether the workman's body is leaning forward (as shown in FIG. 3) or backward (not shown).

In some cases, and depending upon the magnitude of the force generated by the workman's knee and leg, the entire knee pad 1 may also rotate forwards or back over the work surface at the curved front or rear end 28 and 29 of the lower pivot support base 10. At the same time, the evacuated area 26 (of FIG. 4) through the upper knee support cushion 9 and the flex gaps 34 formed at the front of the lower pivot support base 10 will be compressed to absorb stress applied to the knee pad 1. Moreover, the upstanding side walls of the lower pivot support base 10 will be pulled slightly inwardly towards one another in response to the force generated by the user's knee as the enlarged heads 42 of pivots 40 (of FIG. 4) correspondingly exert pulling forces at the respective pivot slots 32 of pivot support base 10.

Because of the ability of the upper knee support cushion 9 (and the intermediate pivoting reinforcement plate 12 attached thereto) to rotate as the workman rocks back and forth, the pressure normally applied by the work surface against the workman's knee will be reduced. That is to say, because the workman's knee is suspended above the work surface by and rotatable relative to the lower pivot support base 10, the pressure generated against the workman's knee cap as his body rocks back and forth will be deflected away from the knee. Thus, by wearing the knee pad 1 herein disclosed, the workman's knee will experience reduced discomfort and minimized risk of potential injury compared with a conventional knee pad where pressure is applied directly to the knee cap, especially in situations where the workman must kneel down and rock back and forth during long periods of a workday.

Figure 10:
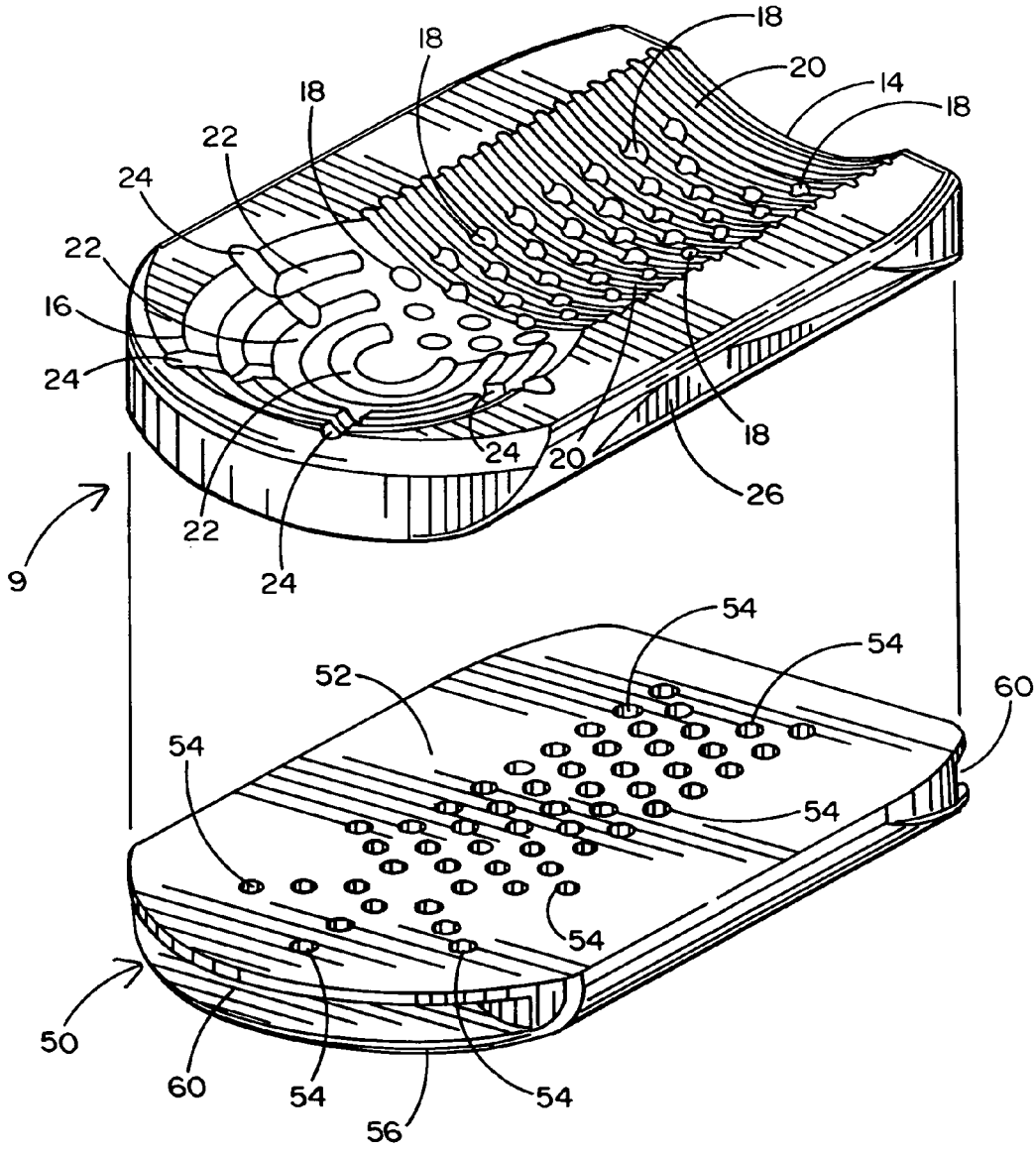
FIG. 10 is an exploded view of the components which form a flexible knee pad according to an alternate preferred embodiment of this invention.
Figure 11:
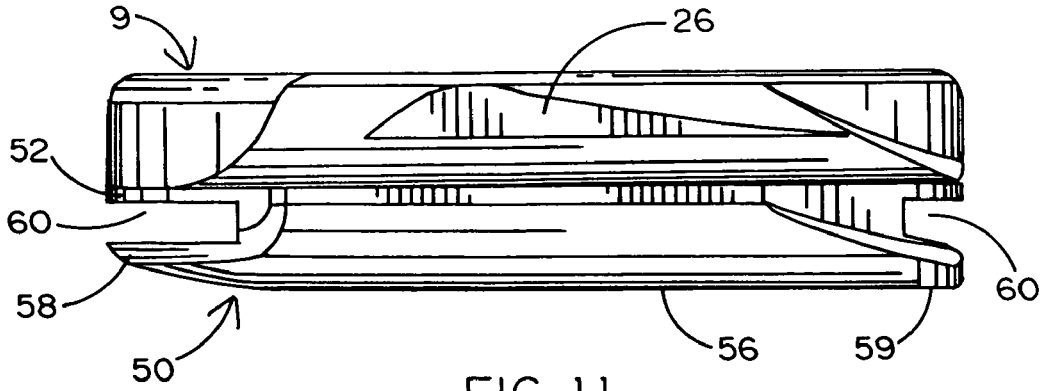
FIG. 11 is a side view of the knee pad components of FIG. 10 in their assembled configuration.
Figure 12:
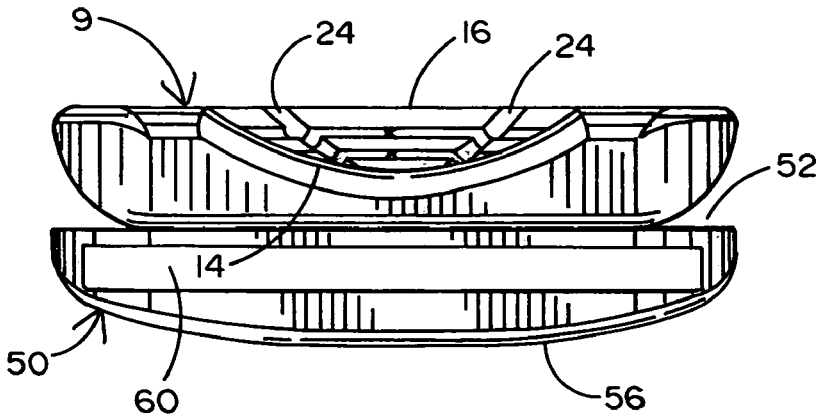
FIG. 12 shows a rear view of the assembled knee pad components of FIG. 11.
Figure 13:
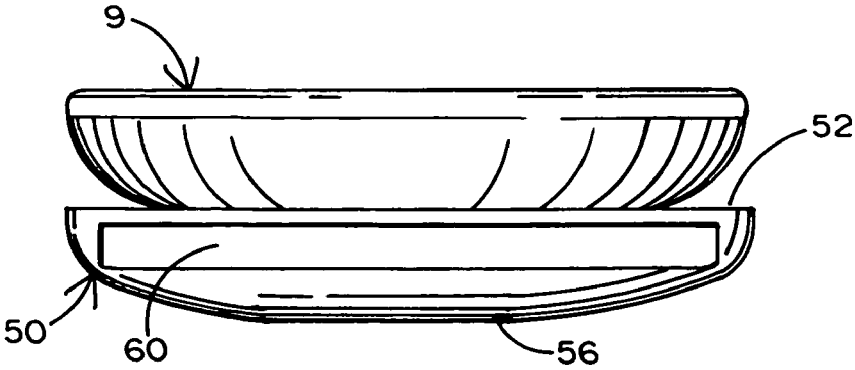
FIG. 13 shows a front view of the assembled knee pad components of FIGS. 11 and 12.

The three-piece flexible knee pad 1 shown in FIGS. 1-9 includes an upper knee support cushion 9, a lower support base 10, and an intermediate pivoting reinforcement plate 12. According to an alternate embodiment of this invention, and referring concurrently to FIGS. 10-13 of the drawings, the knee pad may be reduced to two pieces. In this case, the modified knee pad includes the same relatively soft, compressible upper knee support cushion 9 (best shown in FIG. 10) for which identical reference numerals are used to identify the identical features thereof. However, in the alternate embodiment of FIGS. 10-13, the intermediate pivoting reinforcement plate (designated 12 in FIGS. 1-9) and the lower pivot support base (designated 10) are now replaced by a combined lower support and reinforcement base 50. The upper knee support cushion 9 and the lower support and reinforcement base 50 may be surrounded by the same air-permeable outer covering or shell (designated 3 in FIGS. 1-9) against which the force of the workman's knee is applied (not shown) when he works in a kneeling position along a work surface. In the alternative, the outer shell 3 may be eliminated altogether.

The lower support reinforcement base 50 is manufactured from a resilient, spring-like material. The top of the lower base 50 is preferably flat to create a bed 52 for receiving and supporting the upper knee support cushion 9. The upper knee support cushion 9 and the lower support and reinforcement base 50 are attached to one another (best shown in FIGS. 11-13) by means of an adhesive bond, or the like.

An array of air holes 54, similar to those designated 38 shown in FIG. 4, extend vertically through the lower base 50. Some of the air holes 54 through the rear of lower base 50 are axially aligned with the through holes 18 formed through the longitudinal trough 14 at the rear of upper knee support cushion 9. Other ones of the air holes 54 through the front of the lower base 50 are arranged in rows that communicate with the concentric channels 22 formed through the dish-shaped recess 16 at the front of knee support cushion 9. The continuous air flow paths created by through holes 18 and air holes 54 and by the channels 22 and the rows of air holes 38 establish a ventilation system through the upper knee support cushion 9 and the lower support and reinforcement base 50 to enable the flexible knee pad of FIGS. 10-13 to breathe via the permeable outer shell.

Located opposite the flat bed 52 to rest upon the work surface is the bottom 56 of the resilient lower support and reinforcement base 50. The front end of the bottom 56 is curved (best shown in FIG. 11) to facilitate the ability of the lower base 50 and the upper knee support cushion 9 seated thereon to rotate over the work surface as the workman rocks his body and shifts his weight forward between the erect and horizontal positions of FIGS. 2 and 3.

The lower support and reinforcement base 50 includes a continuous, longitudinally-extending evacuated area 16 that runs from the front end 58 to the rear end 59 thereof and lies between the flat bed 52 and the opposing bottom 56. The evacuated area 60 communicates with the air holes 54 through the flat bed 52 of lower base 50 to provide exhaust paths for the previously-described ventilation system that allows the knee pad of FIGS. 10-13 to breathe while in use. The evacuated area 60 causes the resilient lower support and reinforcement base 50 to function as a compression spring. More particularly, support base 50 will be temporarily compressed such that the flat bed 52 is moved through the evacuated area 60 towards the bottom 56 when a force generated by the workman's knee is transmitted through the upper knee support cushion 9 to the bed 52 of the lower support and reinforcement base 50.

By virtue of the knee pad shown in FIGS. 10-13, and like the flexible knee pad 1 of FIGS. 1-9, the workman's knee laying against the recess 16 and trough 14 of upper knee support cushion 9 will be suspended above the work surface by the lower support and reinforcement base 50. Thus, the pressure applied to his knee cap by the work surface as the workman rocks back and forth and shifts his weight will be absorbed by the upper knee support cushion 9 and the spring-like action of the resilient lower support base 50 as the flat bed 52 moves towards the bottom 56 to diminish the evacuated area 60 therebetween. Accordingly, the workman's knee will experience reduced discomfort and minimized risk of potential injury compared with conventional knee pads when the workman wears the knee pad of FIGS. 10-13 and must kneel down and rock back and forth for long periods during a workday.

The invention claimed is:

1. A knee pad to be worn over the knee of a workman while kneeling on a work surface, said knee pad comprising:

a knee support upon which the workman's knee is laid;

a support base to rest upon the work surface; and pivot means by which to couple said knee support to said support base, said knee support lying above and spaced from said support base such that the knee cap of the workman lies in front of the location at which said knee support is coupled by said pivot means to said support base, said knee support rotating at said pivot means in a first direction so as to move towards said support base in front of said pivot means when the workman rocks his body and shifts his weight forward of said pivot means, and said knee support rotating at said pivot means in an opposite direction so as to move towards said support base behind said pivot means when the workman rocks his body and shifts his weight rearward of said pivot means.

2. The knee pad recited in claim 1, wherein said knee support is manufactured from a cushion material that is adapted to be compressed in response to a force generated by the workman's knee lying thereagainst.

3. The knee pad recited in claim 1, wherein said knee support includes a dish-shaped recess located at one end and a longitudinal trough located at the opposite end and communicating with said recess, said dish-shaped recess being sized and shaped to accommodate the workman's knee, and said longitudinal trough being sized and shaped to accommodate a portion of the workman's leg.

4. The knee pad recited in claim 1, wherein said knee support has at least one air passage extending therethrough to provide ventilation when said knee pad is worn over the knee of the workman.

5. The knee pad recited in claim 1, further comprising an outer covering surrounding said knee support and said support base, said outer covering having a longitudinal depression in which to receive the knee and a portion of the workman's leg, such that a force generated by the workman's knee and leg laying upon the knee support is transmitted through the depression of said outer covering to said knee support.

6. The knee pad recited in claim 1, wherein said pivot means includes a pair of pivots projecting from said knee support, and said support base has a pair of pivot slots formed therein, said pair of pivots being received in respective ones of said pair of pivot slots so that said knee support is pivotally coupled to and suspended by said support base above the work surface.

7. The knee pad recited in claim 1, wherein said knee support has a curved front end, said knee support adapted to rotate over the work surface on the curved front end thereof when the workman leans his body and shifts his weight towards said curved front end.

8. The knee pad recited in claim 1, wherein said knee support includes a compressible knee cushion against which the workman's knee is laid and a pivoting reinforcement bed upon which said knee cushion is seated, such that said compressible knee cushion and said pivoting reinforcement bed rotate together relative to said support base.

9. The knee pad recited in claim 8, wherein said pivot means includes a pair of pivots projecting from said pivoting reinforcement bed, said support base having a pair of pivot slots formed therein, said pair of pivots being received in respective ones of said pair of pivot slots so that said pivoting reinforcement bed and said compressible knee support cushion seated thereon are pivotally coupled to and suspended by said support base above the work surface.

10. A knee pad to be worn over the knee of a workman while kneeling on a work surface, said knee pad comprising:

an upper knee support cushion against which the workman's knee is laid;

a lower pivot support base to rest upon the work surface;

an intermediate pivoting reinforcement bed upon which said upper knee support cushion is seated, said upper knee support cushion, said intermediate pivoting reinforcement bed and said lower pivot support base lying in parallel alignment one above the other, and pivot means by which to couple said intermediate pivoting reinforcement bed to said lower pivot support base, said intermediate pivoting reinforcement bed being suspended above said lower pivot support base, whereby the knee cap of the workman lies in front of the location at which said intermediate pivoting reinforcement bed is coupled by said pivot means to said lower pivot support base such that said pivoting reinforcement bed and said knee support cushion seated thereon rotate together at said pivot means in a first direction so as to move towards said pivot support base in front of said pivot means when the workman rocks his body and shifts his weight forward of said pivot means, and said pivoting reinforcement bed and said knee support cushion rotate together at said pivot means in an opposite direction so as to move towards said pivot support base behind said pivot means when the workman rocks his body and shifts his weight rearward of said pivot means.

11. The knee pad recited in claim 10, wherein said upper knee support cushion includes a dish-shaped recess located at one end and a longitudinal trough located at the opposite end and communicating with said recess, said dish-shaped recess being sized and shaped to accommodate the workman's knee, and said longitudinal trough being sized and shaped to accommodate a portion of the workman's leg.

12. The knee pad recited in claim 11, further comprising an outer covering surrounding said upper knee support cushion, said lower pivot support base, and said intermediate pivoting reinforcement bed, said outer covering having a longitudinal depression in which to receive the knee and a portion of the workman's leg, said longitudinal depression lying above said upper knee support cushion, such that a force generated by the receipt of the workman's knee and leg portion in said depression is transmitted through said outer covering to the dish-shaped recess and the longitudinal trough of said upper knee support cushion.

13. The knee pad recited in claim 10, further comprising at least one air passage extending through each of said intermediate pivoting reinforcement bed and said upper knee support cushion seated thereon, said air passages communicating with one another to provide ventilation when said knee pad is worn over the knee of the workman.

14. The knee pad recited in claim 10, wherein said pivot means includes a pair of pivots projecting from said intermediate pivoting reinforcement bed, said lower pivot support base having a pair of pivot slots formed therein, said pair of pivots being received in respective ones of said pair of pivot slots so that said pivoting reinforcement bed and said knee support cushion seated thereon are pivotally coupled to and suspended from said lower pivot support base so as to lie in spaced parallel alignment with said pivot support base above the work surface.

15. The knee pad recited in claim 10, wherein said intermediate pivoting reinforcement bed is manufactured from a flexible material.

* * * * *